US006467841B1

(12) United States Patent
Henschel et al.

(10) Patent No.: US 6,467,841 B1
(45) Date of Patent: Oct. 22, 2002

(54) LUMBAR SUPPORT

(75) Inventors: Robert Henschel; Akhtar Aziz, both of Chicago, IL (US)

(73) Assignee: A & H Design Concepts, Inc., Chicago, IL (US)

( * ) Notice: Subject to any disclaimer, the term of this patent is extended or adjusted under 35 U.S.C. 154(b) by 389 days.

(21) Appl. No.: 08/993,542

(22) Filed: Dec. 18, 1997

(51) Int. Cl.[7] ..... A47C 7/42

(52) U.S. Cl. ..... 297/284.5; 297/239; 297/219.1; 108/53.1; 108/53.3; 108/91; 248/346.01

(58) Field of Search ..... 297/284.5, 284.4, 297/284.7, 219.1, 219.11, 62, 105, 233, 236, 239, 232, 256.16, 452.26, 452.27, 452.3, 452.32, 452.35, 452.36; 108/91, 53.1, 53.8, 106, 116, 157.1; 248/346.1, 678

(56) References Cited

U.S. PATENT DOCUMENTS

| | | | | | |
|---|---|---|---|---|---|
| 291,931 | A | * | 1/1884 | Puitti | |
| 2,888,976 | A | * | 6/1959 | Hart | 297/239 X |
| 3,228,358 | A | * | 1/1966 | Sepe et al. | 108/53.3 |
| 3,277,849 | A | * | 10/1966 | Talbot | 108/53.3 |
| 3,412,502 | A | * | 11/1968 | Riches | 297/239 X |
| 3,934,933 | A | * | 1/1976 | Long | 297/219.1 |
| 4,187,786 | A | * | 2/1980 | Feig et al. | 108/91 X |
| 4,301,743 | A | * | 11/1981 | Keller | 108/53.1 |
| 4,474,370 | A | | 10/1984 | Oman | |
| 4,621,809 | A | | 11/1986 | Pearl | |
| 4,752,067 | A | | 6/1988 | Colonello | |
| 4,763,894 | A | | 8/1988 | Barrett | |
| 4,802,462 | A | | 2/1989 | Reiss et al. | |
| 4,879,956 | A | * | 11/1989 | Shuert | 108/53.3 |
| 4,953,857 | A | | 9/1990 | Lemire | |
| 4,974,839 | A | | 12/1990 | Cantor | |
| 5,007,633 | A | | 4/1991 | Lemire | |
| 5,042,800 | A | | 8/1991 | Walter | |
| 5,069,447 | A | | 12/1991 | Snyderman et al. | |
| 5,100,130 | A | | 3/1992 | Shoebrooks | |
| 5,110,122 | A | | 5/1992 | Moore et al. | |
| 5,125,883 | A | | 6/1992 | Shoebrooks | |
| 5,143,057 | A | | 9/1992 | DePasquale | |
| 5,286,089 | A | * | 2/1994 | Goldman | 297/452.26 |
| 5,304,109 | A | | 4/1994 | Shockley | |
| 5,368,537 | A | | 11/1994 | Felice | |
| 5,749,555 | A | * | 5/1998 | Albrecht | 248/346.01 |
| 5,782,450 | A | * | 7/1998 | Spencer | 248/346.01 X |

FOREIGN PATENT DOCUMENTS

| | | | | |
|---|---|---|---|---|
| NL | 46646 | * | 9/1939 | 297/219.1 |

* cited by examiner

*Primary Examiner*—Rodney B. White
(74) *Attorney, Agent, or Firm*—Greer, Burns & Crain, Ltd.

(57) ABSTRACT

A lumbar support comprises a plurality of stackable platelets adapted to underlie a user's lumbar area, a pad attached to a top surface of an uppermost one of the platelets, and male/female mating connectors at the interface between platelets for interlocking the platelets together, and a protective pad on a bottom surface of a lowermost platelet. The platelets have variable height so that the user may selectively and incrementally adjust the height of the lumbar support to meet his or her particular lumbar support needs. The lumbar support preferably further includes a belt and/or guide members for adjustably and removably attaching the platelets to an exercise device, such as a weight lifting bench.

16 Claims, 7 Drawing Sheets

LUMBAR SUPPORT

FIELD OF THE INVENTION

The present invention relates to exercise equipment. More specifically, to lumbar supports, and lumbar supports that can be attached to, placed at different positions on, and removed from exercise equipment, such as a workout bench.

BACKGROUND OF THE INVENTION

For many years, the general public, fitness community and medical community have been interested in exercise to firm, tone and strengthen the human body. Many exercise regimens have been developed and practiced, including aerobics, abdominal exercises and weight lifting to name but a few. Numerous exercise devices have also been developed to facilitate various exercise regimens and to support and comfort the user or demonstrator engaged in the exercise activity.

One area of the human body that frequently requires support during exercise is the lumbar region of the lower back. The benefits of providing lumbar support while performing activities such as sit ups and many weight lifting exercises are well known and accepted.

Various devices have been developed in an attempt to meet this need. For example, U.S. Pat. No. 4,752,067 to Colonello discloses an exercise device with a unitary curved spine support section that cradles the user's lower back during exercise. U.S. Pat. Nos. 5,100,130 and 5,125,883 both to Shoebrooks, describe a removable, semi-circular, resilient lumbar support cushion, for abdominal exercise devices. Similarly, U.S. Pat. No. 5,368,537 to Felice discloses an abdominal exercise apparatus that includes a removable resilient cushion, to support the user's lower back and for added comfort.

Lumbar support is also important when performing many kinds of weight lifting exercises. Toward this end, a number of lumbar supports have been developed that are attached to weight lifting and other types of workout benches. For example, U.S. Pat. No. 4,621,809 to Pearl discloses a fixed, molded resilient intermediate member, that has a curved surface replicating a typical lower back curvature. U.S. Pat. Nos. 4,953,857 and 5,007,663 describe a lumbar cushion that has a strap for attaching the cushion to the bench. The position of the cushion can be adjusted in the longitudinal direction of the bench. Similarly, U.S. Pat. No. 4,474,370 discloses a weight lifting bench with a lumbar cushion that can slide along the bench in its longitudinal direction and be positioned at any longitudinal location. U.S. Pat. No. 5,069,447 discloses an inflatable lumbar cushion that is built into the padding of a weight lifting bench. U.S. Pat. No. 5,304,109 shows an inflatable lumbar support whose position can be adjusted in the longitudinal direction of a weight lifting bench.

Depending upon the exercise, users frequently need to raise or lower the lumbar support device. They may also need to move the support from one piece of exercise equipment to another. They may even wish to place the lumbar support on the floor when performing appropriate floor exercises. In this regard, these other lumbar supports have not been entirely satisfactory. Most of the prior art lumbar supports are not adjustable or have limited adjustment capability. Also, many of the prior art lumbar supports are soft and unduly compressible. They can not provide adequate support. Furthermore, numerous prior art lumbar supports are designed to be uniquely connected to a specific exercise device, such as a highly specialized piece of abdominal exercise equipment or workout bench. They can not be used with traditional pieces of exercise apparatus. Still other prior art lumbar supports can not be used alone on a floor, without risking damage to the floor and without occupying a prohibitively large amount of floor space. Furthermore, many prior art lumbar supports are inherently difficult and costly to manufacture, inventory, ship, demonstrate and store in the home or work place. These and other limitations have previously been recognized, but remain unresolved.

OBJECT OF THE INVENTION

It is an object of the invention to provide a lumbar support that is versatile so that it can be efficiently used alone when performing floor exercises, or with a variety of different exercise devices.

It is a further object of the invention to provide a lumbar support that is highly adjustable in height and position along the longitudinal axis of a workout bench.

It is another object of the invention to provide a lumbar support that is automatically self aligning in the longitudinal and transverse directions of a workout bench, and that can easily and quickly be installed and used, without employing tools or training.

It is an additional object of the invention to provide a lumbar support that has a soft comfortable pad, that will not be unduly compressed when subjected to the user's weight or exercise motions.

It is a further object of the invention to provide a quality, light weight, durable lumbar support that can be easily and cost effectively manufactured, shipped, demonstrated and sold.

It is another object of the invention to provide a lumbar support that causes minimal wear and tear to exercise equipment or any surface, such as a floor, to which it is attached or placed upon.

It is the final object of the invention to provide a small and compact lumbar support that can easily be stored in places such as the home, office or even in the trunk of a car.

SUMMARY OF THE INVENTION

In fulfillment of the objects of the invention, a novel and unique lumbar support is provided.

In the preferred embodiments, the key elements of the invention consist of a plurality of stackable platelets. A pad and fabric cover are also provided which are attached to the top surface of an uppermost platelet. The invention also contains a means at the interface between platelets for interlocking the platelets together.

The platelets are relatively thin, planar members, with a longitudinal dimension that generally conforms to the lumbar region of the human lower back, since the invention underlies the user's lumbar region when in use.

For all of the embodiments of the invention, the uppermost covered, padded platelet can be used alone, without any modification, if the user so desires. Even so, the platelet should be equipped with the easily formed interlocking feature, so that additional platelets can effectively be stacked underneath it. This will accommodate changes in the user's needs and preferences which are likely to occur with time.

A number of modifications can easily be made to the lumbar support and/or to standard exercise equipment to facilitate the attachment of the lumbar support to the exercise equipment. For example, one or more pairs of side guide members or a strap arrangement can be attached to one of the platelets so that the lumbar support can be aligned and secured to the exercise equipment.

In the preferred embodiments, the interlocking of two adjacent platelets is achieved by one or more mating pairs of connectors that are formed in the planar surfaces of the platelets. More specifically, an outwardly projecting or male dimple is located on an upper face of a lower platelet. The male dimple mates with a corresponding inwardly projecting or female dimple on a lower face of an adjoining upper platelet. The female dimples receive the male dimples, thereby automatically aligning and interlocking the platelets together.

There are many other ways to interlock platelets together. In some cases other valuable benefits can also be achieved. For example, the mating connectors may be comprised of a rib and mating slot. Ribs can be formed into the platelets which can strengthen, stiffen and thereby prevent the platelets from warping while they are being formed. Desirably, an outwardly projecting or male rib is formed in the upper surface of a platelet while a mating, inwardly projecting or female slot is formed in the bottom surface of the interfacing platelet. Hence, the ribs can also serve to automatically interlock and align adjacent platelets together.

Optionally, each platelet of the invention may be made of molded plastic and may include one or more selectively positioned holes, that can be of variable size and shape, including slots. Thus, the holes enable each platelet to be formed with less material which reduces its weight. Platelets having holes also cool faster during forming, which permits them to be removed from the mold sooner. Hence, the use of holes can reduce cost and scheduling issues in numerous ways.

Some platelets are thicker or thinner than others, which enables the user to selectively and incrementally adjust the height of the lumbar support to meet their particular needs.

The pad on the top surface of the upper platelet is designed to serve as a resilient cushion. A fabric cover holds it in place. To protect the surface on which the lumbar support is placed from wear and tear, a thin piece of soft durable fabric can be loosely placed underneath the bottom surface of the bottom platelet. Alternatively, it can be attached to the bottom surface of the bottom platelet. The fabric serves as an interface between the bottom platelet and the top surface of the exercise apparatus or the flat surface, such as the floor or firm mattress, on which the lumbar support rests. Alternatively, a small piece of the fabric can be attached to each of the four corners of the bottom surface of the bottom platelet to conserve material and reduce weight.

Finally, all non-interlocking edges and corners can be rounded, on all components of all embodiments of this invention, for the user's safety and comfort.

In the first and most basic embodiment, the lumbar support can be used on a flat surface, with or without other equipment. For example, the invention can be placed directly on a floor and used for sit ups or other abdominal exercises.

In the second embodiment, the lumbar support is attached to an exercise device, such as a workout bench for illustration purposes. A strap is provided to securely attach the platelets to the bench. The longitudinal position of the lumbar support can be changed by moving the unit along the length of the bench. Accordingly, the strap allows for versatility in retrofitting the lumbar support to an existing bench.

The third and fourth embodiments include vertical guide members that are preferably attached to any one of the platelets. The members extend downward to engage the longitudinal sides of the exercise device, which can be a workout bench for illustration purposes. They can also extend to engage any of the platelets that lie above the one to which the guide members are attached. The guide members allow the lumbar support to automatically self align and to prevent it from shifting in the transverse direction of the bench, while it is in use. For additional stability, both guide members and a strap can be employed in combination. Variations of the guide member concept are possible, several of which are described in the "Detailed Description" section that follows.

Accordingly, the lumbar support, which contains no moving parts, can be quickly, easily and safely used without employing tools or prior training. After use, the lumbar support can be conveniently stored in a closet, drawer or under a bed. It can also easily be transported to locations such as the home, work place and remote vacation sites.

The invention consists of a minimum number of parts that can be efficiently manufactured. Typically, platelets will be made of a suitable plastic and will be produced in a multi-cavity injection molding tool. Inserts can also be utilized to form guide members and other details in the platelets. Guide members can also be fabricated separately, using any one of many manufacturing techniques, such as injection molding. If fabricated separately, the guide members can be efficiently attached directly to the exercise apparatus, such as a workout bench, or to one or more platelets.

All components of the invention can be made and assembled to form a strong and durable final product. Furthermore, all components are relatively small, light weight and can easily be stacked during factory storage and packaging. The invention is thus conducive to high volume efficient manufacturing, packaging and shipping.

Other objects and advantages of the invention are addressed by the drawings and detailed description that follows.

Throughout the application, the term "longitudinal" refers to the head-to-toe direction of the user. Thus, "longitudinal" refers to the large dimension of a workout bench, and the small dimension of the lumbar support 10, showm in FIG. 1. The term "transverse" refers to the small dimension of the bench and the large dimension of the lumbar support 10.

DETAILED DESCRIPTION

Figure 1:
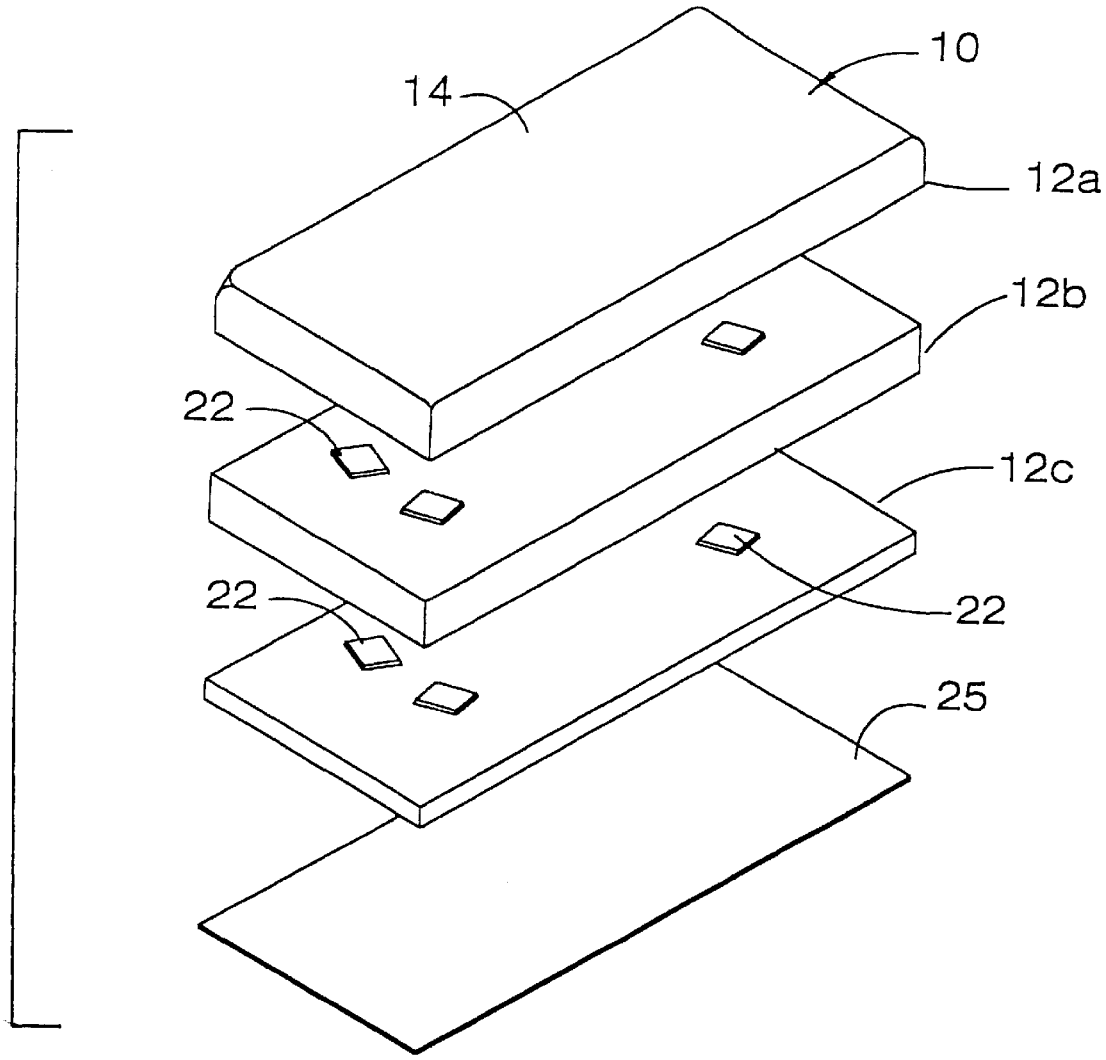
FIG. 1 is an exploded perspective view of the first embodiment of the invention.
Figure 2:
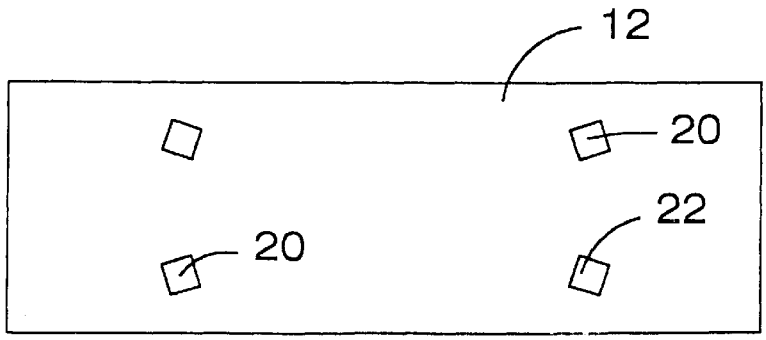
FIG. 2 is a top plan view of a typical platelet of the invention.
Figure 3:
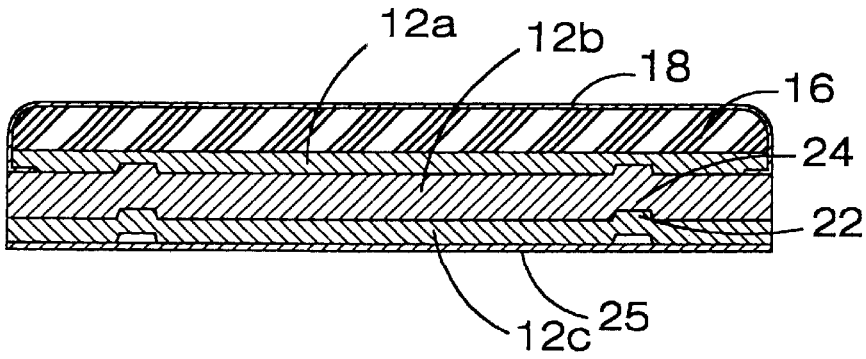
FIG. 3 is a transverse cross-sectional view of the first embodiment of the invention.

From FIG. 1 it is seen that, for the first embodiment, the lumbar support is comprised of one or more platelets 12*a*–12*c*. Three platelets are illustrated in FIG. 1 for convenience, however, any number can be used. The uppermost platelet 12*a* contains a pad that is covered 14 on its top surface. Other platelets, which will usually be present, are interconnected at their respective interfaces by male/female connectors 20 that will prevent the platelets from slipping one against another during use. A preferred male/female connector pair comprises mating dimples 22 and 24, as shown in FIGS. 1–3. Each pair of mating dimples 22 and 24 contains a projecting male dimple 22 and a recessed female dimple 24. The male dimple 22 fits snugly into the female dimple 24. Hence, both transverse and longitudinal movement or sliding of one platelet relative to another is prevented. Throughout the application, the term "longitudinal" refers to the head-to-toe direction of the user. Thus, "longitudinal" refers to the large dimension of a workout bench, and the small dimension of the lumbar support 10, showm in FIG. 1. The term "transverse" refers to the small dimension of the bench and the large dimension of the lumbar support 10.

As shown in FIG. 3, the male dimples 22 are preferably located on the top surface of each platelet, while the female dimples 24 are located on the bottom surface. The female dimples are vertically aligned with their corresponding male dimples. The shape of the dimples is preferably that of a multi-sided regular polygon, most desirably a square, to provide tight fitting corners that will eliminate slipping between platelets. The drawings show four dimples on each platelet, however any number, at least one can be used.

Figure 4:
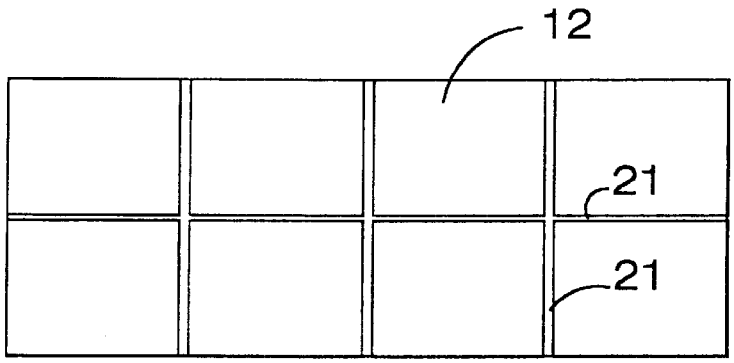
FIG. 4 is a top plan view of an alternate platelet design that contains ribs.

Many other interlocking schemes are possible. FIG. 4 illustrates one such alternate scheme that comprises ribs 21 which are projecting upwardly from the top surface of platelet 12. Ribs 21 can be formed into each platelet in its longitudinal and/or transverse direction. Although one transverse rib and three longitudinal ribs are shown in FIG. 4, it is understood that any number of transverse and/or longitudinal ribs may be used. Ribs 21 serve two main purposes. First, the ribs 21 can strengthen and stiffen the platelets so as to remove the warping that could otherwise occur during the fabrication of the platelets. Second, the ribs 21 can be formed into one interfacing platelet surface while mating inward slots are formed in the other interfacing surface, so that the ribs will mate with the slots. Hence, the ribs 21 can also serve to interlock adjacent platelets together.

The platelets 12, shown in FIG. 1, can be composed of any suitable material including wood and metal, however, plastic that can be injection molded is preferred. The platelets 12 are preferably made in variable thickness so that the user can selectively and incrementally adjust the height of the lumbar support to meet their individual needs. A mold, with multiple cavities and inserts, can be used to form platelets that vary in thickness and other structural detail.

The covered pad 14, shown in FIG. 1, is preferably comprised of a layer of padding 16 and a cover 18, as shown in FIG. 3. The padding 16 can be composed of any suitable material such as foam rubber, or it can be an air or liquid filled bladder. The cover 18 is preferably fabricated from an impermeable, perspiration resistant material that is also insensitive to ultraviolet light, such as vinyl. In the preferred embodiment, the cover 18 is attached to the upper platelet, but it can also be attached to one or more other platelets. The cover 18 is attached to platelet 12*a*, shown in FIG. 1, by any suitable means, which includes traditional stitching. In an alternative approach, the lower, inner edge, can be equipped with an elastic band, which can serve a similar function as the elastic band that is attached to a bottom bed sheet. In addition, or alternatively, the inner edge can be equipped with spaced eyelets or grommets. The cover can then be laced to the top platelet 12*a*. Still other means can be used to achieve the same result.

The protective pad 25, is shown in FIGS. 1 and 3. It can be used with any of the lumbar support embodiments disclosed herein. The protective pad 25 can be used to provide protection for the surface on which the lumbar support is to be placed, such as the top of a workout bench or polished wooden floor. The pad is placed between the bottom surface of the bottom platelet and the surface being protected, such as a floor (not shown). A stack of platelets 12*a*–12*c* is then placed on top of the protective pad 25.

Protective pad 25 can be fabricated by die cutting a large sheet of a suitable fabric, such as felt, vinyl, rubber or cotton cloth, into correctly dimensioned sections.

Many modifications and alternatives exist to the protective pad. For example, the pad can have an adhesive backing that would enable it to be securely fastened to the bottom face of the bottom platelet. A sheet can also be cut into a series of small pads that each have the adhesive backing. A small pad can be attached to each of the four corners of the bottom face of the bottom platelet. By choosing a proper adhesive, pads can either be attached permanently or attached so they can be removed or removed and replaced, at the user's discretion.

All non-interlocking edges and corners can be rounded on all components of all embodiments of this invention, for user safety and comfort.

Figure 5:
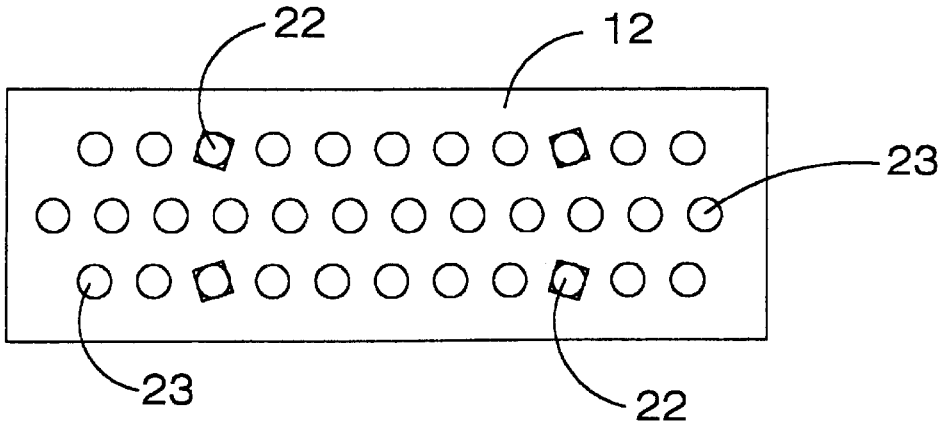
FIG. 5 is a top plan view of a second alternative platelet design that contains holes.

FIG. 5 illustrates another modification that can be made to the platelets, which is particularly beneficial if they are made of plastic and formed by injection molding, which is the preferred choice of material and manufacturing technique. The modification consists of forming at least one selectively positioned hole 23, of any convenient size and shape, in each platelet 12. The axis of each hole is perpendicular to the top and bottom faces of the platelet in which it is formed. The holes may be formed in the planar surfaces of platelet 12 and/or through dimples 22.

The holes 23 serve three main purposes, all of which help to reduce the cost of the platelets. First, the holes enable each platelet to be formed with less plastic, which generates a material cost savings. Second, the holes can enable the mold to fill with plastic and the resulting platelets to cool and solidify faster, while the platelets are still in the mold. The platelets must adequately solidify before they can be removed from the mold. Hence, the platelets can be removed from the mold sooner, which allows more platelets to be produced per hour. In turn, operator labor and molding machine utilization costs can be reduced. Third, the platelets become lighter in weight. Hence, handling, packaging and shipping costs can all be reduced. These benefits can be realized by all platelets of all embodiments of the invention.

Figure 6:
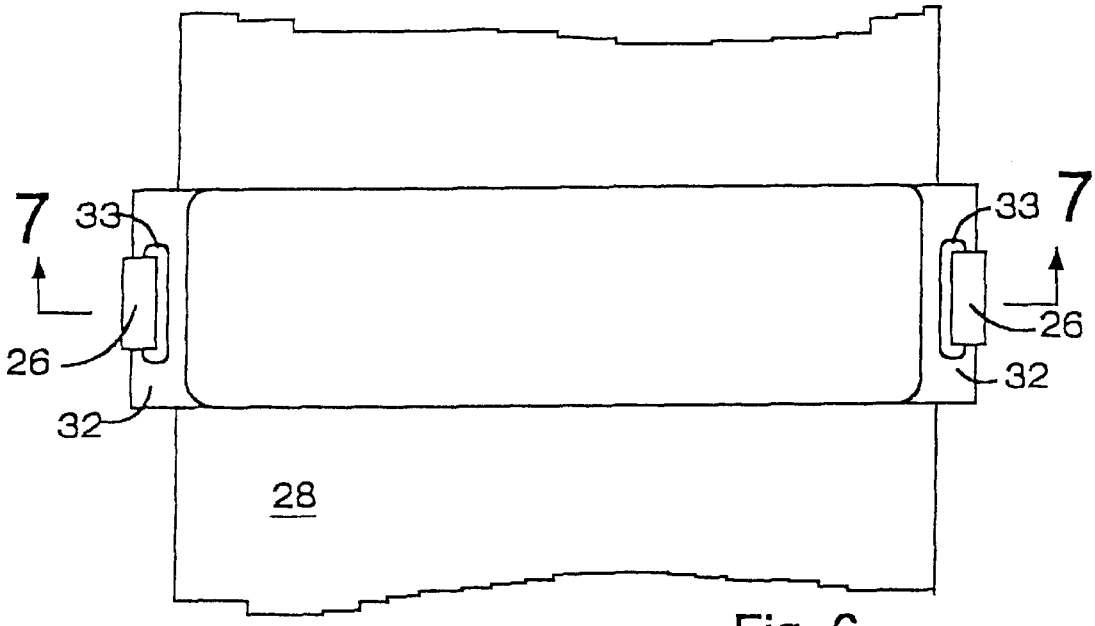
FIG. 6 is a top plan view of the second embodiment of the invention.
Figure 7:
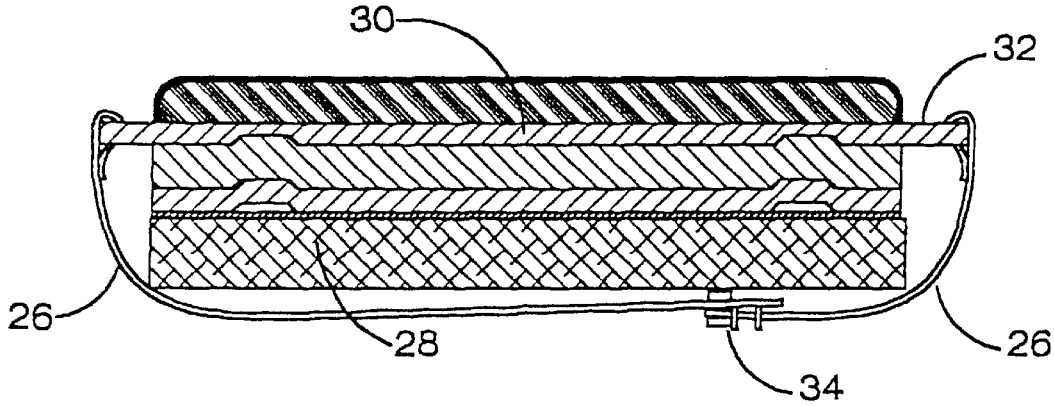
FIG. 7 is a transverse cross-sectional view of the second embodiment of the invention taken along Line 7—7 of FIG. 6.
Figure 8:
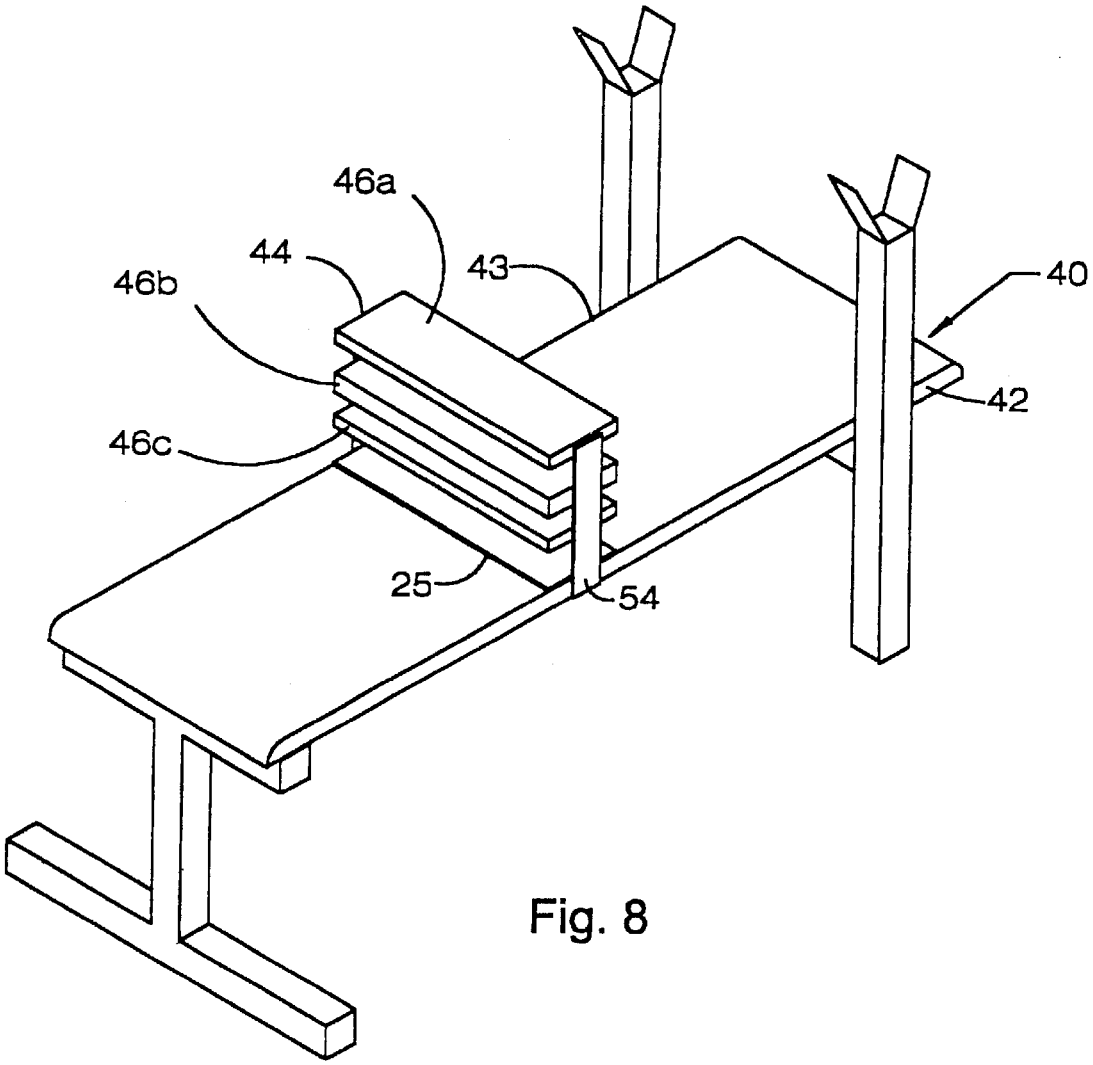
FIG. 8 is an exploded perspective view of the third embodiment of the invention.
Figure 9:
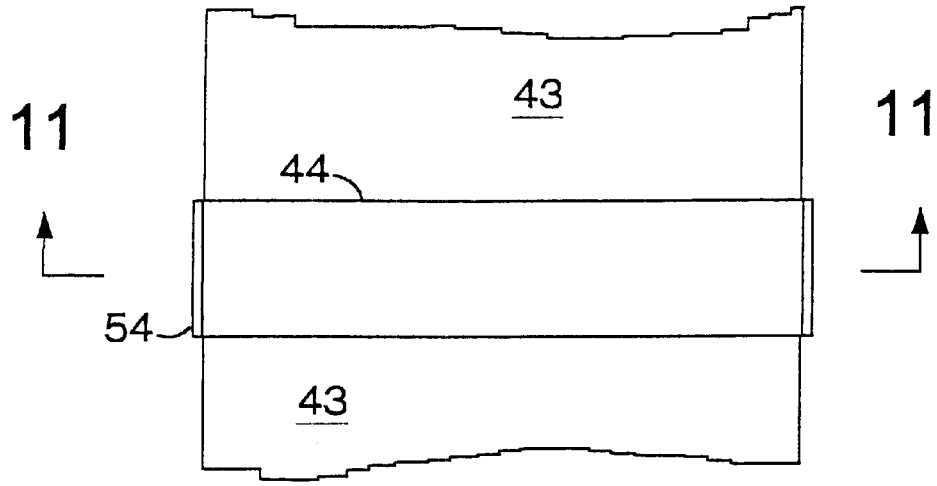
FIG. 9 is a top plan view of the third embodiment of the invention.
Figure 10:
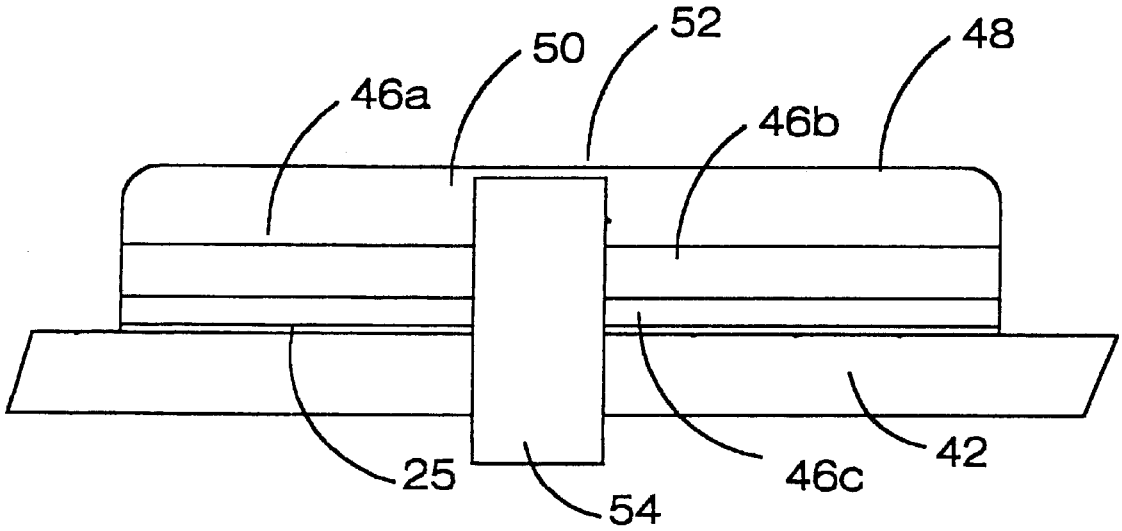
FIG. 10 is a side elevational view of the third embodiment of the invention.
Figure 11:
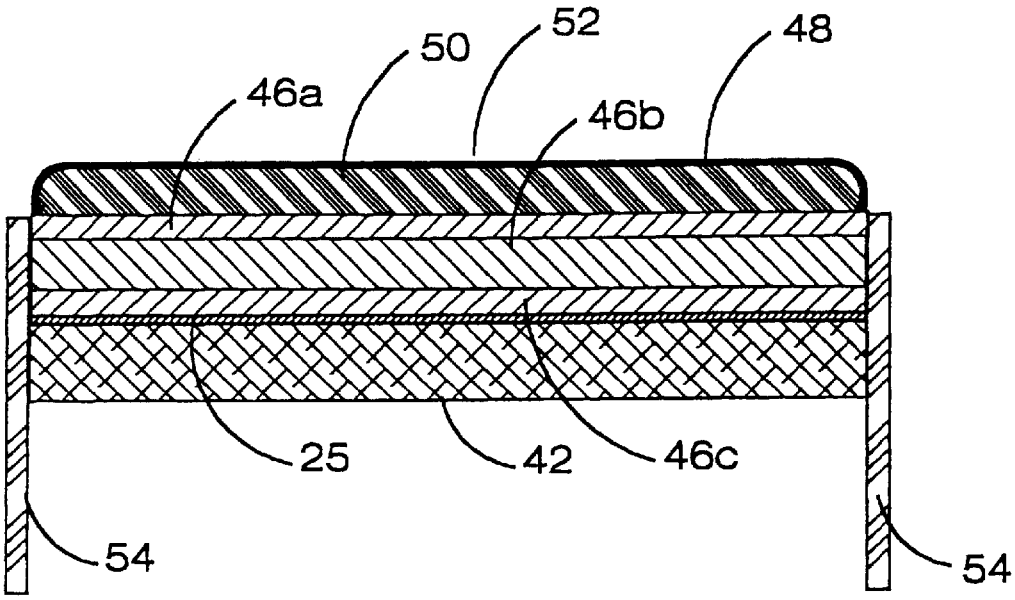
FIG. 11 is a transverse cross-sectional view of the third embodiment of the invention taken along Line 11—11 of FIG. 9.

The second embodiment of the invention is shown in FIGS. 6 and 7. It contains a strap 26 which is provided for retrofitting the lumbar support 10, shown in FIG. 1, to an exercise device, such as a workout bench 28, shown in FIGS. 6 and 7. The top platelet 30, shown in FIG. 7, contains projections 32, having openings 33 therein, for attaching the strap. Strap 26 has a fastener 34, such as a locking cleat, buckle, Velcro fastener or other means for tightening and securing one end of strap 26 to its other end.

The third embodiment of the invention 40 is shown in FIGS. 8–11. This embodiment is considered to be the best mode for practicing the invention in combination with an exercise device, such as a workout or weight lifting bench.

The third embodiment is comprised of an exercise device shown here as a workout or weight lifting bench 42, having a top surface 43 and an adjustable and removable lumbar support 44. The lumbar support 44 consists of at least one stackable platelet 46*a*–46*c*, and a covered pad 48 that is attached to the uppermost platelet 46*a*. As with the other embodiments, the covered pad 48 is comprised of padding 50 and a cover 52. A pair of guide members 54 align the lumbar support 44 with the exercise device 42. In the preferred embodiment, the guide members take the form of guide bars 54 that are secured to at least one of the platelets 46, preferably the top platelet 46*a*, by any suitable means. Examples include the use of thumb screws, interlocking tabs, welding or by being integrally molded to the platelets, if they are plastic.

Alternatively, the guide bars can be attached in a removable or permanent fashion to either or both of the exercise device 42 and the lumbar support 44. Additionally, more than one pair of guide bars can be employed.

The guide bars engage the sides of the exercise surface 43 to restrain movement of the lumbar support in the transverse direction of the exercise device, while permitting the position of the lumbar support to be adjusted in the longitudinal direction. When in operation, the user's back resting on the lumbar support 44 will prevent slippage of the lumbar support in the longitudinal direction of the exercise device.

The lumbar support 44 is adjustable relative to surface 43 in two directions. First, the lumbar support can be adjusted longitudinally on bench 42 by sliding it forward or backward to meet the specific needs and comfort of the user. Second, the height of the support can be adjusted incrementally, by selectively inserting or removing platelets that are relatively thin or thick. Hence, the user can adjust the lumbar support to meet his/her particular needs and comfort.

Figure 12:
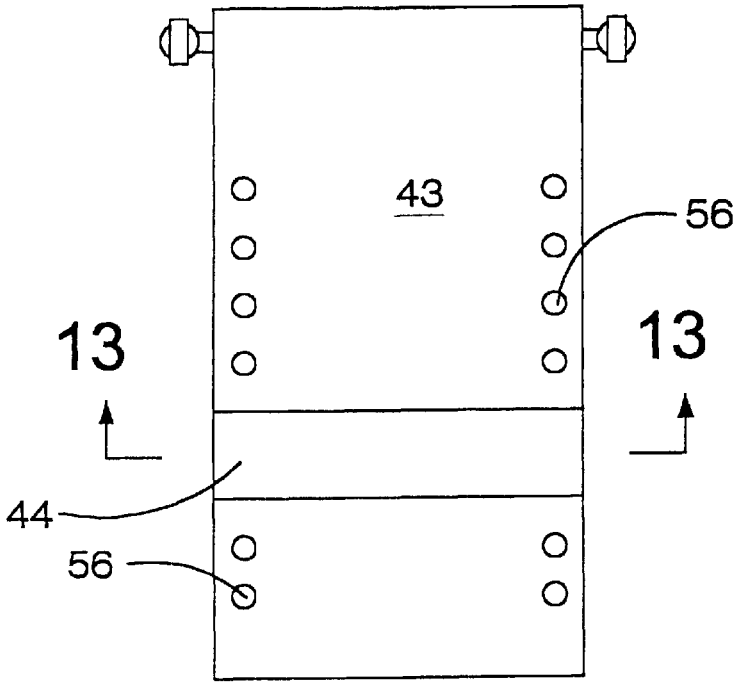
FIG. 12 is a top plan view of the fourth embodiment of the invention.
Figure 13:
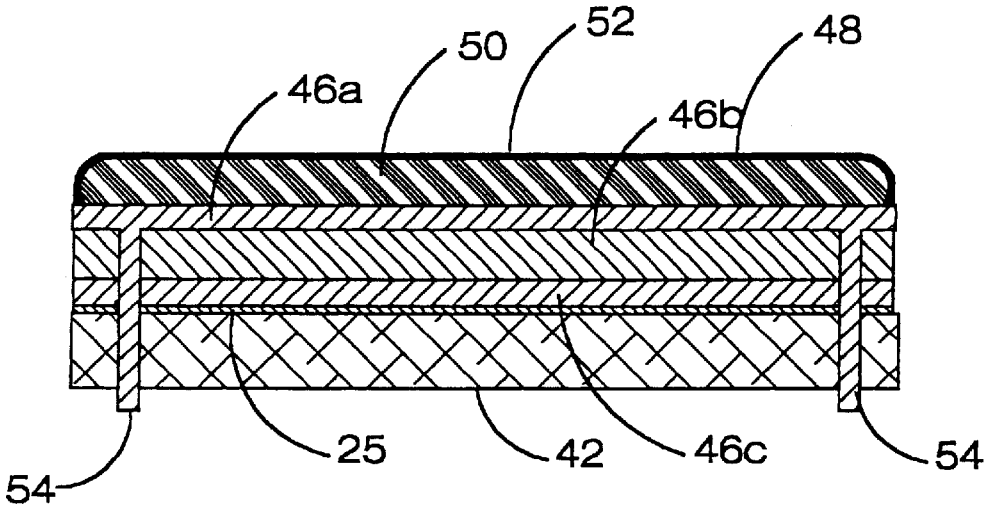
FIG. 13 is a transverse cross-sectional view of the fourth embodiment of the invention taken along Line 13—13 of FIG. 12.

A fourth embodiment is illustrated in FIGS. 12 and 13. It is the same as the third embodiment in most respects and has accordingly been numbered the same. In the fourth embodiment the guide members 54 take the form of a pair of guide pins that, in the preferred embodiment, are received in any one of several pairs of holes 56 in surface 43, or an extension of surface 43. Additionally, rather than one guide pin being used on each side of the lumbar support, two or more guide pins may be used on each side. This causes a corresponding increase in the number of guide pin to hole 56 engagements that take place on each side of the lumbar support. Finally, guide pins 54 can extend through holes within each platelet 46, and thereby supplement or provide the interlocking structure and function that are provided by the mating connectors in the other embodiments. Accordingly, in the fourth embodiment, the guide pins 54 connect the lumbar support to the exercise device restraining both the transverse and longitudinal movement of the overall lumbar support relative to surface 43. They also restrain movement of the individual platelets 46*a*–46*c* relative to one another.

The guide pins can be fabricated from a variety of materials such as wood, metal and the preferred material which is plastic that is formed by injection molding apparatus. The preferred material for the platelets is also plastic that is formed by using similar equipment. Hence, the guide pins and any platelet can be integrally and simultaneously molded together, in the same mold, when they are both made from the same suitable plastic. Alternatively, the guide pins can be joined to the holes in the workout bench, or at least one platelet, by any number of other methods such as welding, press fitting, screw attachment and the use of adhesives.

While embodiments of the invention have been described in detail, various modifications and other embodiments thereof can be devised, by an individual skilled in the art, without departing from the spirit and scope of the invention, as defined by the appended claims.

What is claimed is:

1. A lumbar support for use with an exercise device, comprising:

a plurality of substantially rectangular stackable platelets, each of said platelets having a longitudinal dimension adapted to conform to the lumbar region of the human back and a transverse dimension that is greater than the longitudinal dimension;

means for attaching said platelets to the exercise device;

a pad attached to the top surface of an uppermost one of said platelets; and means connected to said platelets for interlocking said platelets together.

2. A lumbar support as in claim 1, said interlocking means comprising at least one pair of mating connectors on said platelets at each interface between platelets, each said pair of mating connectors comprising a male connector on one interfacing platelet and a corresponding female connector on the other interfacing platelet.

3. A lumbar support as in claim 2, wherein said at least one pair of mating connectors comprise a male dimple on an upper surface of a lower one of said interfacing platelets and a corresponding mating female dimple on a bottom surface one an upper one of said interfacing platelets.

4. A lumbar support as in claim 3, wherein said dimples are multi-sided polygons.

5. A lumbar support as in claim 2, wherein said mating connectors comprise an outwardly projecting rib on an upper surface of a lower one of said interfacing platelets and a mating slot on a bottom surface of an upper one of said interfacing platelets.

6. A lumbar support as in claim 2, wherein each said interface has a plurality of mating connectors.

7. A lumbar support for use with an exercise device comprising:

a plurality of substantially rectangular stackable platelets, each of said platelets having a longitudinal dimension adapted to conform to the lumbar region of the human back and a transverse dimension that is greater than the longitudinal dimension;

a pad attached to the top surface of an uppermost one of said platelets;

means connected to said platelets for interlocking said platelets together; and means for attaching said platelets to the exercise device, said attaching means comprising a belt attached to said uppermost platelet, said belt for firmly engaging the exercise device to hold said plurality of platelets to the exercise device.

8. A lumbar support as in claim 1, wherein said attaching means comprises at least one pair of vertical, substantially rigid guide members attached to one of said platelets, said guide members extending to engage the exercise device.

9. A lumbar support as in claim 8, wherein said guide members engage and hold a plurality of platelets.

10. A lumbar support as in claim 1, wherein said platelets have variable thickness to allow the user to incrementally adjust the height of the lumbar support.

11. A lumbar support as in claim 1, wherein said pad comprises a layer of padding and a cover removably attached to said uppermost one of said platelets, said cover enclosing said padding and holding said padding to said uppermost platelet.

12. A lumbar support as in claim 1, further comprising a plurality of holes through said platelets.

13. A lumbar support as in claim 1, resting on an exercise surface, further comprising a protective pad removably sandwiched between a bottom surface of a lowermost one of said platelets and the exercise surface.

14. An exercise device with lumbar support comprising:

an exercise device having a surface adapted to receive the back of a user;

a plurality of stackable platelets on said surface of said exercise device and positioned to underlie the user's lumbar area, said platelets having a longitudinal dimension smaller than a transverse dimension so that said platelets have a generally rectangular shape, said longitudinal dimension adapted to correspond to the user's lumbar area;

a pad on a top surface of an uppermost one of said platelets;

at least one pair of mating connectors on said platelets at each interface between platelets, said mating connectors comprising a male connector on one interfacing platelet and a corresponding female connector on the other interfacing platelet; and means for adjustable and removably attaching said platelets to said surface of said exercise device.

15. An exercise apparatus as in claim 14, wherein said adjustable and removable means comprises a pair of vertical, substantially rudgid guide members attached to at least one of said platelets and extending to engage said exercise device.

16. An exercise apparatus as in claim 14, further comprising a protective pad sandwiched between, but not bonded to, said platelets and said surface of said exercise device.

* * * * *